US005626173A

United States Patent [19]

Groult

[11] Patent Number: 5,626,173

[45] Date of Patent: May 6, 1997

[54] CONTAINER FOR PRESSURIZED FLUID, PRESSURIZED-FLUID DELIVERY ASSEMBLY AND METHOD OF BLEEDING A HYDRAULIC BRAKE CIRCUIT

[75] Inventor: Jacques Groult, Verneuil-sur-Avre, France

[73] Assignee: Safet Embamet, Villeneuve-la-Garenne, France

[21] Appl. No.: 262,253

[22] Filed: Jun. 20, 1994

[30] Foreign Application Priority Data

Jun. 18, 1993 [FR] France ..... 93 07422

[51] Int. Cl.[6] ..... A65B 1/04; A65B 3/04; B67C 3/00

[52] U.S. Cl. ..... 141/329; 141/25; 141/67; 141/382; 141/384; 222/82; 222/386.5

[58] Field of Search ..... 141/67, 98, 382, 141/383, 384, 329, 18, 21, 25, 27; 222/387, 389, 82, 83, 83.5, 386.5; 188/352; 60/584

[56] References Cited

U.S. PATENT DOCUMENTS

| | | | |
|---|---|---|---|
| 2,509,570 | 5/1950 | Lee | 222/386.5 |
| 2,670,874 | 3/1954 | Wilkerson | 222/61 |
| 2,735,589 | 2/1956 | Milster et al. | 222/386.5 |
| 2,925,937 | 2/1960 | Schmidt et al. | 222/80 |
| 3,583,491 | 6/1971 | Lindeberg | 222/389 |
| 3,964,641 | 6/1976 | Langensiepen et al. | 222/389 |
| 4,785,629 | 11/1988 | Ennis, III et al. | 60/584 |
| 5,186,370 | 2/1993 | Ricketts | 222/545 |
| 5,410,881 | 5/1995 | Ellis | 60/584 |

FOREIGN PATENT DOCUMENTS

| | | |
|---|---|---|
| 800987 | 7/1936 | France . |
| 2552056 | 3/1985 | France . |
| 3339257 | 5/1985 | Germany . |
| 533045 | 3/1973 | Switzerland . |

*Primary Examiner*—Henry J. Recla
*Assistant Examiner*—Timothy L. Maust
*Attorney, Agent, or Firm*—Young & Thompson

[57] ABSTRACT

This container includes a neck (26), the free end of which is equipped with an orifice for outflow of the pressurized fluid contained in the container, closed off by a perforatable cover (30) in order to release the pressurized fluid. The pressurized-fluid delivery assembly comprises the container and an element (36) for connecting the neck (26) to pressurized-fluid supply pipe (37) of a hydraulic circuit, these being equipped with elements (40) for piercing the cover which are able to be actuated after connection of the neck to the supply pipe (37). This assembly makes it possible to supply, for example, a brake-fluid reservoir of a hydraulic pressurized-brake-fluid brake circuit so as to bleed this circuit.

7 Claims, 2 Drawing Sheets

CONTAINER FOR PRESSURIZED FLUID, PRESSURIZED-FLUID DELIVERY ASSEMBLY AND METHOD OF BLEEDING A HYDRAULIC BRAKE CIRCUIT

FIELD OF THE INVENTION

The present invention relates to a container for pressurized fluid, a pressurized-fluid delivery assembly and a method of bleeding a hydraulic brake circuit.

BACKGROUND OF THE INVENTION

In order to carry out the bleeding of a hydraulic brake circuit for a motor vehicle, it is usually necessary to involve at least two operators, one actuating the brake pedal in order to pressurize the hydraulic circuit and the other monitoring the outflow of brake fluid via the bleed orifices located in the region of the brakes of the wheels of the vehicle.

SUMMARY OF THE INVENTION

The object of the invention is especially to make it possible for the bleeding of a hydraulic brake circuit for a motor vehicle to be conveniently carried out by a single operator.

For this purpose, the subject of the invention is a container for pressurized fluid, characterized in that it includes a neck, the free end of which is equipped with an orifice for outflow of the pressurized fluid contained in the container, closed off by a perforatable cover in order to release the pressurized fluid.

According to other characteristics of this container:

- the cover is manufactured in a composite material made of aluminum/polyethylene and is heat-sealed onto the free end of the neck;
- the fluid has a pressure of a few atmospheres;
- the pressure of the fluid is imposed by a plunger, internal to the container, which can move between a chamber containing pressurized gas and a chamber containing the fluid;
- the pressurized fluid comprises brake fluid for a motor vehicle;
- the neck is threaded on the outside so as to make possible the screwing onto this neck either of a cap for protecting the cover, or of a member for connecting the neck to a hydraulic circuit.

The subject of the invention is also a delivery assembly for a pressurized-fluid hydraulic circuit, comprising a container such as defined above, characterized in that, in addition, it includes means for connecting the neck of the container to a pipe for supplying the hydraulic circuit with pressurized fluid, these being equipped with means for piercing the cover which are able to be actuated after connection of the neck to the supply pipe.

Preferably, the connecting means comprise a connector intended to be screwed in a leaktight manner onto the neck, and a punch-pusher mounted so as to slide in a leaktight manner in the connector between a standby position and a position for piercing the cover, this punch-pusher being equipped with a channel, one end of which is connected to the supply pipe and the other end of which emerges in line with the neck of the container, this latter end including a projection for piercing the cover.

The subject of the invention is also a method of bleeding a hydraulic brake circuit including a brakefluid reservoir, characterized in that the reservoir is supplied with pressurized brake fluid so as to pressurize the hydraulic brake circuit.

Preferably, pressurized brake fluid is delivered to the brake-fluid reservoir with an assembly such as defined above, in which the container contains the pressurized fluid.

BRIEF DESCRIPTION OF THE DRAWINGS

An illustrative embodiment of the invention will be described hereinbelow, with reference to the appended drawings in which.

DETAILED DESCRIPTION OF THE INVENTION

Figure 1:
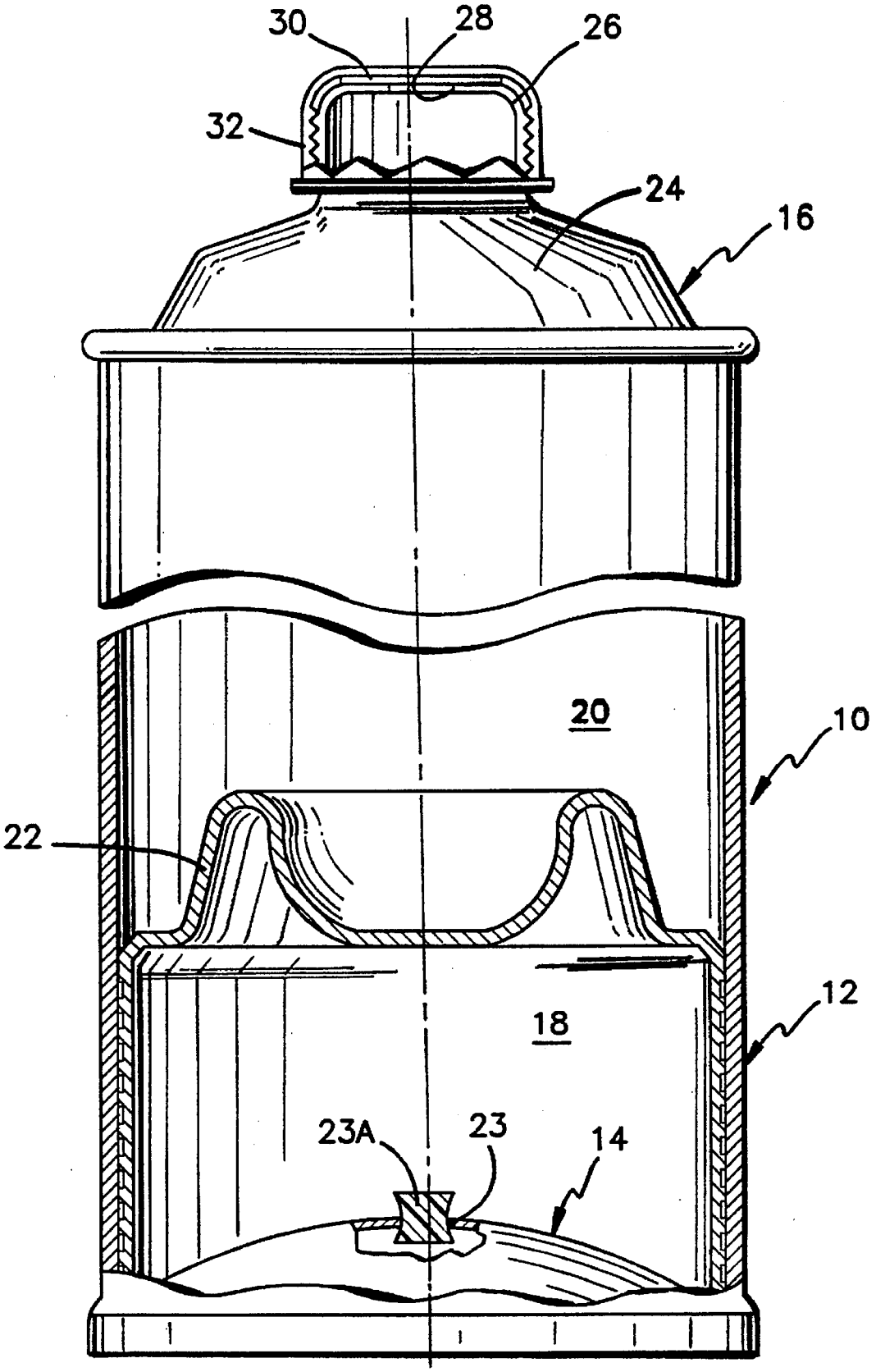
FIG. 1 is a front view, with cutaways along longitudinal sections, of a container for pressurized fluid according to the invention.

FIG. 1 represents a container for pressurized fluid according to the invention, designated by the general reference 10, including a metal body 12, of cylindrical general shape, equipped at one end with a bottom 14 and at the opposite end with a top 16.

The bottom 14 and the top 16 are fixed onto the rest of the body 12 by known means, for example by crimping.

The body 12 of the container includes two internal compartments 18, 20 separated by a plunger 22 mounted so as to slide axially inside the body 12.

The compartment 18, delimited between the bottom 14 and the plunger 22, is filled with a pressurized gas of known type.

The compartment 20, delimited between the top 16 and the plunger 22, is fitted with a fluid normally used in hydraulic brake circuits, for example mineral oil.

Under the effect of the pressure of the gas contained in the compartment 18, the plunger 22 has the tendency to impose on the fluid contained in the compartment 20 a pressure of a few atmospheres.

The filling of the container 10 with pressurized gas and with fluid is undertaken by known means. The means for filling with the gas comprise an orifice 23, made in the bottom 14, closed off by a plug 23A made of elastomer.

The top 16 of the body of the container includes a necking-down part 24 extended by a neck 26 threaded on the outside.

The free end of the neck 26 includes an axial orifice 28 closed off by a cover 30 preferably manufactured in a composite material including an aluminum layer coated with a polyethylene layer.

The cover 30 is heat-sealed onto the free end of the neck 26, by known means, this making it possible to ensure leaktight connection between the neck 26 and the cover 30 withstanding the pressure of the liquid contained in the compartment 20.

In order to protect the cover 30, a protective cap 32 is screwed onto the neck 26.

A delivery assembly for a pressurized-fluid hydraulic circuit will now be described with respect to FIGS. 2 to 4, in which this assembly is designated by the general reference 34.

The assembly 34 includes a container 10 such as represented in FIG. 1, the protective cap 32 having been removed from the neck 26 and means 36 for connecting this neck to a flexible pipe 37 for supplying the hydraulic circuit with pressurized fluid, this circuit not being represented in the figures.

Figure 2:
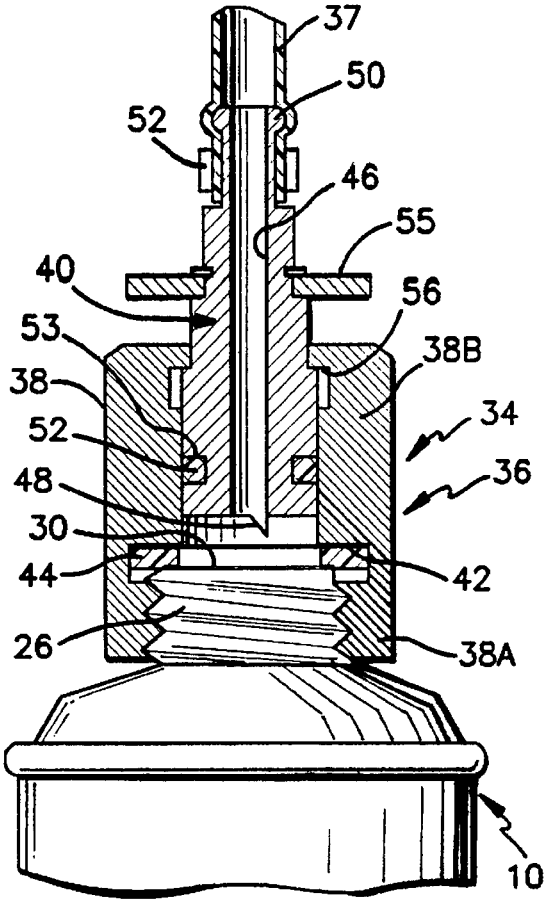
FIG. 2 is a front view, in partial longitudinal section, of a pressurized-fluid delivery assembly, the punch-pusher of the connector being in the standby position.
Figure 3:
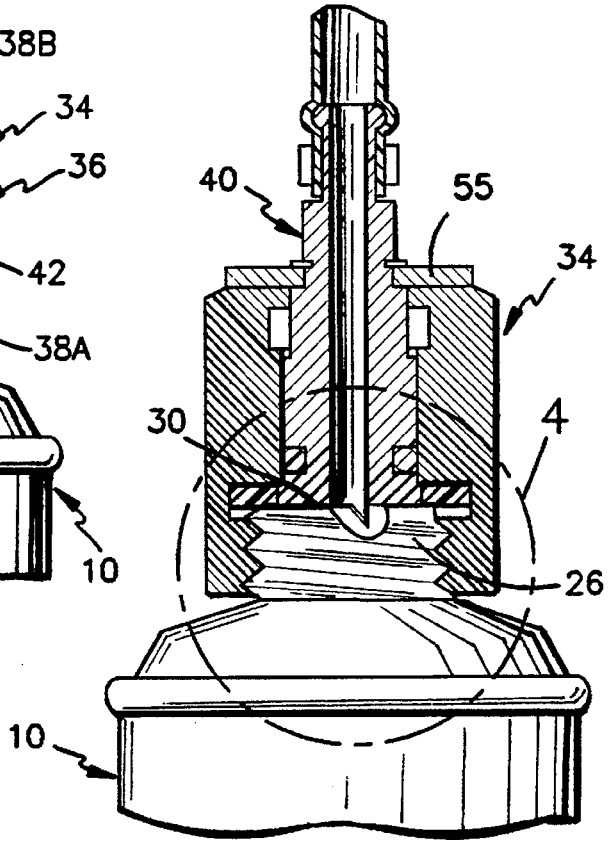
FIG. 3 is a view similar to FIG. 2, in which the punch-pusher of the connector is in the piercing position.

The connecting means 36 comprise a sleeve forming a connector 38 including an end 38A threaded on the inside, intended to be screwed onto the neck 26, and another end 38B which is bored and forms a guide for a punch-pusher 40 of cylindrical general shape, mounted so as to slide axially in the connector 38 between a standby position, such as represented in FIG. 2, and a position for piercing the cover 30, such as represented in FIG. 3.

The internal surfaces of the two ends 38A, 38B are separated by an annular shoulder 42 forming a bearing surface for an annular seal 44 interposed between this shoulder 42 and the free end of the neck 26.

The punch-pusher 40 is pierced axially with a channel 46 for connecting the neck 26 to the flexible pipe 37.

That end of the channel 46 emerging in line with the neck 26, internal to the connector 38, is extended by a pointed projection 48 intended to pierce the cover 30. That end of the channel 46 opposite the neck 26, external to the connector 38, forms a nozzle 50 intended to be fitted into a corresponding end of the flexible pipe 37, leaktightness between this pipe and the nozzle 50 being ensured by a hose clamp 52.

Leaktightness between the internal surface of the end 38B of the connector and the punch-pusher 40 is especially ensured by an O-ring seal 53 located in an annular groove 54 made in the punch-pusher 40.

The punch-pusher 40 is actuated by a thrust disk 55 fixed by known means onto the external part of the connector 38 of this punch-pusher.

The punch-pusher 40 is positioned in the standby position by complementary shoulders 56 made on the contacting surfaces of this punch-pusher and of the connector 38. Preferably, the punch-pusher 40 is held in the standby position by elastic means of known type, not represented in the figures.

Figure 4:
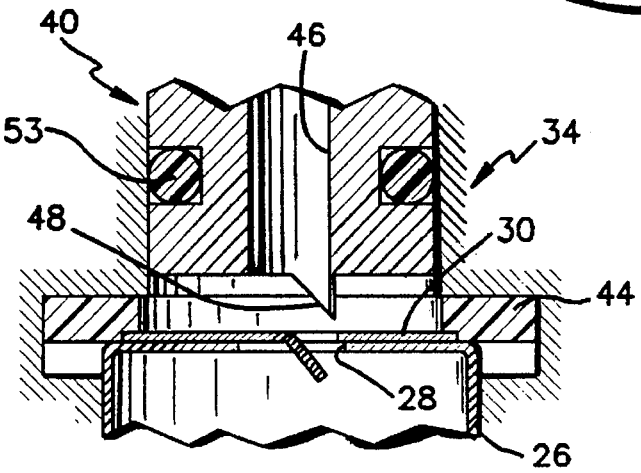
FIG. 4 is a detail view of the part 4 circled in FIG. 3, the punch-pusher being once again in the standby position.

A method will now be described for bleeding a hydraulic brake circuit for a motor vehicle employing an assembly 34 such as represented in FIGS. 2 to 4.

Initially, the protective cap 32 is removed from the neck 26 and the connector 38 is screwed onto the latter, and then that end of the flexible pipe 37 opposite the connector 38 is connected in a manner known per se to a brake-fluid reservoir to which the hydraulic brake circuit is connected in a conventional manner. Next, the punch-pusher 40 is actuated by pressing on the disk 55 so that the projection 48 pierces the cover 30, as is represented in FIG. 3. After piercing the cover 30, the pressurized brake fluid contained in the container 10 flows out through the orifice 28 in the neck 26, the channel 46 and the flexible pipe 37 so as to supply the brake-fluid reservoir and to pressurize the hydraulic brake circuit.

It will be noted that, under the effect of the pressure of the fluid, the punch-pusher 40 is moved to its standby position, as represented in FIG. 4.

It will also be noted that, after screwing the connector 38 right down onto the neck 26, the leaktightness of the connecting means 34 is ensured, this making it possible to carry out the piercing of the cover 30 and the release of the pressurized fluid without risk of leakage.

The rise in the pressure in the hydraulic brake circuit makes it possible to bleed the latter.

Thus, a single operator may simultaneously pressurize the hydraulic brake circuit by actuating the punch-pusher 40 of the assembly 34 and may monitor the bleed orifices of the hydraulic brake circuit which are located in the region of the brakes of the vehicle.

I claim:

1. Container for a pressurized fluid comprising a container having brake fluid therein for a motor vehicle, the container including a neck having a free end which is equipped with an orifice for outflow of the pressurized brake fluid contained in the container, closed off by a perforatable cover in order to release the pressurized brake fluid.

2. Container according to claim 1, wherein the cover is manufactured in a composite material made of aluminum/polyethylene and is heat-sealed onto the free end of the neck.

3. Container according to claim 1, wherein the pressure of the fluid is imposed by a plunger, internal to the container, which is movably mounted between a chamber containing pressurized gas and a chamber containing the fluid.

4. Container according to claim 1, wherein the neck is threaded on the outside so as to make possible the screwing onto this neck of a cap for protecting the cover.

5. Container according to claim 1, wherein the neck is threaded on the outside so as to make possible the screwing onto this neck of a member for connecting the neck to a hydraulic circuit.

6. Delivery assembly for a pressurized-fluid hydraulic circuit, comprising a container according to claim 1, including in addition means for connecting the neck of the container to a supply pipe for supplying the hydraulic circuit with pressurized brake fluid, said connecting means being equipped with means for piercing the cover which are able to be actuated after connection of the neck to the supply pipe.

7. Delivery assembly according to claim 6, wherein the neck is threaded on the outside and wherein the connecting means comprise a connector intended to be screwed in a leaktight manner onto the neck, and a punch-pusher mounted so as to slide in a leaktight manner in the connector between a standby position and a position for piercing the cover, said push-puncher being equipped with a channel, said channel having a first end which is connected to the supply pipe and a second end which emerges in line with the neck of the container, said second end including a projection for piercing the cover.

* * * * *